US005497524A

United States Patent [19]

Fleissner

[11] Patent Number: 5,497,524

[45] Date of Patent: Mar. 12, 1996

[54] METHOD FOR CLEANING CONTINUOUSLY ADVANCING WEB-FORM TEXTILE MATERIAL AND DEVICE FOR WORKING THE METHOD

[75] Inventor: Gerold Fleissner, Zug, Switzerland

[73] Assignee: Fleissner GmbH & Co. KG, Egelsbach, Germany

[21] Appl. No.: 242,349

[22] Filed: May 13, 1994

[30] Foreign Application Priority Data

May 13, 1993 [DE] Germany ..... 43 16 061.1

[51] Int. Cl.[6] ..... D06B 3/10

[52] U.S. Cl. ..... 8/149.1; 8/151

[58] Field of Search ..... 8/149.1, 151; 68/5 C, 68/5 D, 19.1, 205 R

[56] References Cited

U.S. PATENT DOCUMENTS 3,954,404 5/1976 Childers et al. ..... 8/149.1

4,165,547 8/1979 Parlin et al. ..... 8/149.1

4,403,359 9/1983 Kutz ..... 8/149.1

4,411,663 10/1983 Lauchenauer ..... 8/149.1

*Primary Examiner*—Frankie L. Stinson

*Attorney, Agent, or Firm*—Antonelli, Terry, Stout & Kraus

[57] ABSTRACT

Textile webs that are to be dyed, printed, or otherwise finished must be fed to such a treatment process in a clean condition. For continuous cleaning without large apparatus and without environmental impact, the pile of the textile web is saturated with a liquid containing washing-active substances and compounds which are caused to foam under the effects of heat especially under steam. After steaming, the foam that is produced in the steam for cleaning is vacuumed away with the contaminants it contains.

4 Claims, 2 Drawing Sheets

METHOD FOR CLEANING CONTINUOUSLY ADVANCING WEB-FORM TEXTILE MATERIAL AND DEVICE FOR WORKING THE METHOD

FIELD OF INVENTION

This invention relates to a method and device for cleaning a continuously advancing web-form textile material, wherein the material is soaked in a washing-active liquid that contains one or more surfactants and a compound that has a high adsorptivity for the contaminants being washed out and no affinity for the fibers of the textile material, and is subjected to a steam treatment immediately thereafter.

BACKGROUND OF THE INVENTION

DE 32 13 840 Al teaches the application of a foam to the pile side to wash or rinse a textile web of material and then to subject the textile material immediately thereafter to a steam treatment, in order then to rinse it with water to wash out the dissolved contaminants. It is also intended to perform the foam application in two stages, with the first applied foam initially being vacuumed off with the dissolved contaminants or squeezed out of the textile material and only then is the textile material precleaned in this fashion, fed into the steamer with a second applied foam. It is important for both stages that the foam prepared from one or more surfactants that have no affinity for the fibers of the textile material but exhibit a high adsorptivity for the contaminants being washed out, be prepared before the application to the textile material and be merely applied. This method does not ensure any intensive contact between the foam and the fibers of a thick pile, especially not over its complete length down to the roots. Complete cleaning is therefore not possible with this method.

Another treatment method is disclosed in DE 30 26 349 Al which teaches a cleaning method in which a foam is likewise poured onto the textile material, and is worked into the textile material before steaming. This treatment method, which has a pronounced influence on the pile, destroys the pile at least partially and produces a great deal of fluff, so that such working of foam is not suitable for textile materials with a pile.

Of course, the same applies when, as in foam dyeing as known from DE 30 45 644 Al, a liquid is applied to the textile material but the foam must then be produced by fulling or the like on the textile material.

SUMMARY OF THE INVENTION

The goal of the invention is to provide a method and a device with which the above-mentioned problems can be overcome. The textile material, especially with a pile, must be deep-cleaned without using large amounts of water or washing agent in a simple and brief continuous processing method without fluff being produced by forced mechanical working of the nap.

Taking its departure from the method of the type heretofore disclosed, the invention proposes the following for achieving the stated goal: the textile material is saturated with a liquid containing chemicals such as foaming agents to generate foam in a steam atmosphere, the textile material is transported to a steamer wherein the washing-active foam is generated; there the textile material is steamed under saturated steam conditions; and after passing through the steamer, the textile material is vacuumed from the visible or exposed side.

The advantage of this method is that the added liquid can be immediately conveyed without any difficulty down to the base of the pile into the textile material. When the foam is created under the influence of temperature in the steamer, it rises from the roots of the fibers to the tips thus transporting the contaminants to the surface of the textile material. There the contaminants can easily be vacuumed off in an environmentally friendly manner without additional washing water.

Of course, the process can be repeated or the textile material can be fed once again into the steamer without adding further liquid in order to align the nap laid down during vacuuming without disturbing the pile side.

BRIEF DESCRIPTION OF THE DRAWINGS

The device for working this method consists of an assembly of elements which are known of themselves. Advantageously, the elements are associated with one another in a special arrangement for this method and are further described with reference to the accompanying drawings wherein.

DETAILED DESCRIPTION OF THE INVENTION

Figure 1:
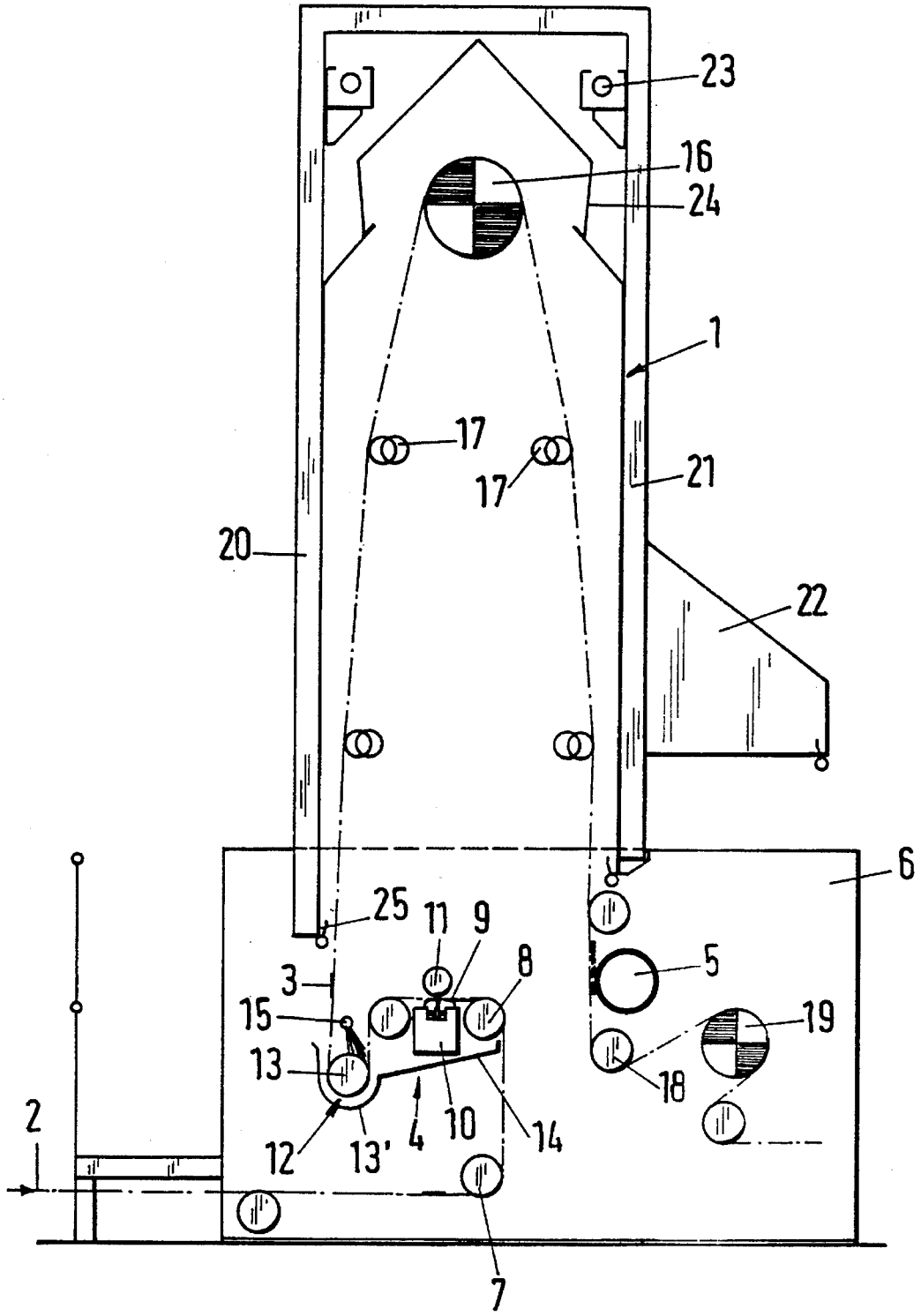
FIG. 1 is a vertical section through a shaft steamer in the transport direction of the web of textile material.
Figure 2:
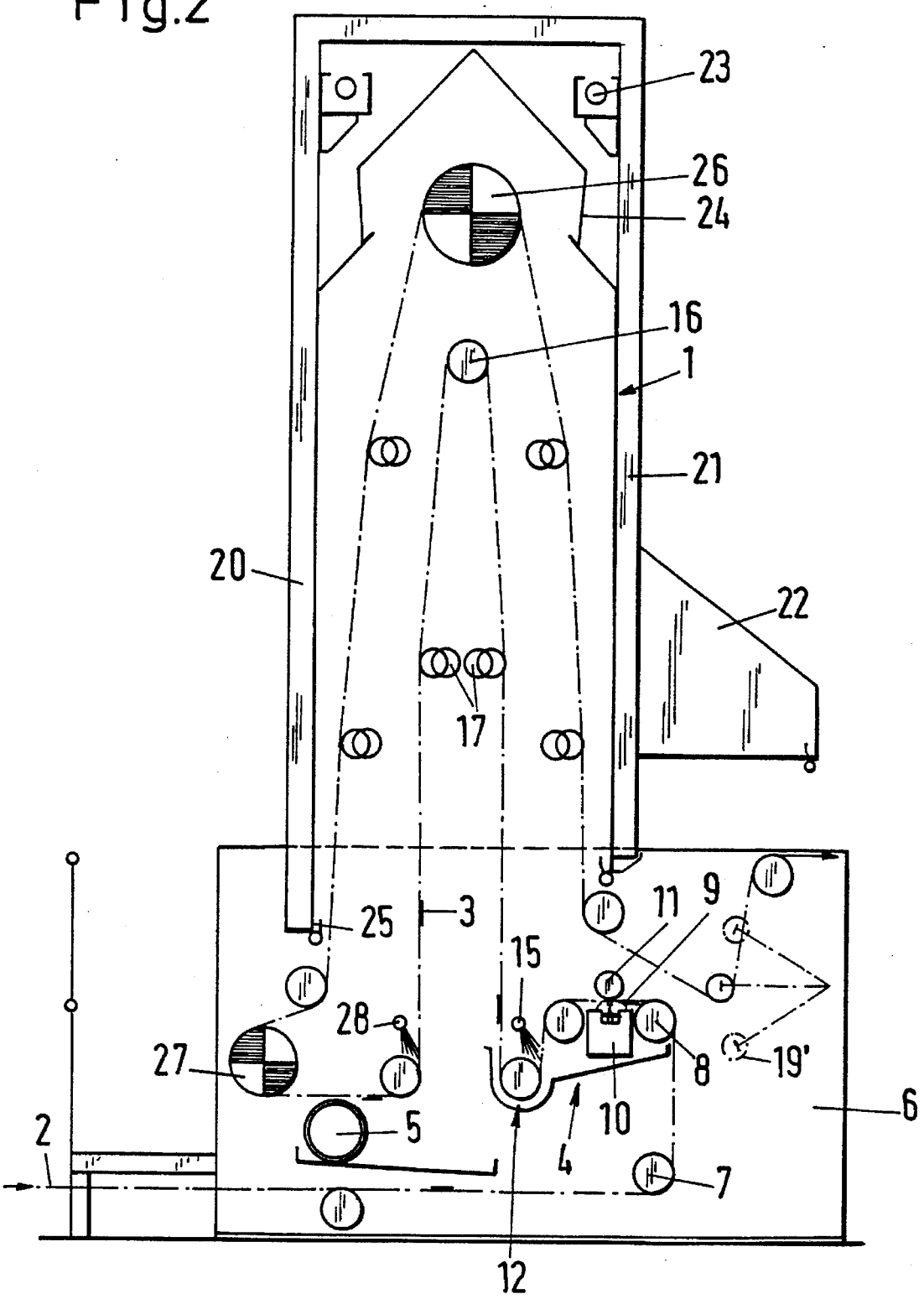
FIG. 2 is a shaft steamer similar to the one shown in FIG. 1 but with a different arrangement for guiding the textile material.

The apparatus shown in FIGS. 1 and 2 is a cleaning or washing device for a textile web wherein a steamer, here shaft steamer 1 is used. For cleaning and especially prewashing a continuously advancing web of textile material 2, which can have a pile 3, initially a liquid is applied to the pile through the application device 4 located below steamer 1 and then the web 2 is transported into the steam atmosphere for foaming the washing-active liquid. This foam, which transports the contaminants to the surface of the textile material, is then vacuumed away outside steamer 1 at vacuum device 5, whereupon cleaning is complete.

The cleaning device according to FIG. 1 consists individually of a stand or support frame 6, which supports application device 4, steamer 1, and vacuum device 5. Web 2, which travels with pile 3 upward, is deflected around deflecting rollers 7, 8, so that the pile is facing downward and then travels through a liquid outlet slot 9. Slot 9 extends only over the working width and ensures a uniform application of liquid over the length of the slot. For this purpose, the device consists of a beam 10 to which the liquid is supplied by one or more connections not shown. By suitable distribution of the liquid in beam 10 similar to the device according to DE 40 26 198.0 Al it is uniformly distributed and passes over the length of slot 9 into the pile of web 2. Above web 2, at its back, a pressure roller 11 travels in order to influence the penetration of the liquid into pile 3. It is possible then to feed web 2 directly into steamer 1 or to deflect it again in the direction of trough 12, formed by an immersion roller 13 and a gutter 13'. Trough or channel 13' extends with a runoff sheet 14 below beam 10 to catch excess liquid. On roller 13, pile 3 of web 2 can be dipped or the web can be sprayed only from above with liquid. For this purpose, a spray tube 15 is directed into the gap between the downward traveling web 2 and the dip roller 13, so that the liquid is forced by roller 13 from the back into textile material or web 2.

The liquid which is guided at the application device into the web, especially into the pile thereof, is a special mixture of washing-active chemicals and foaming agents that foam under thermal energy. The adsorptivity of the washing-active substances for the contaminants contained in the textile material and the simultaneous lack of affinity for the fibers causes the contaminants to be loosened from the fibers. Then each particle of dirt is carried by the resultant foam upward to the tips of the fluff fibers in order to be vacuumed easily therefrom.

For steaming in a saturated steam atmosphere, web 2 then travels upward into shaft steamer 1 which is open at the bottom, for which purpose the steamer deflecting roller 16 which is located at the top and is preferably driven is provided in the steamer housing. Web 2 travels over spreading guide rollers 17 back to stand 6 in which, ahead of the next deflecting roller 18, vacuum device 5 is positioned relative to the pile or the visible side of the webs of goods. The web then goes to the next treatment assembly over a speed-controllable roller 19 as shown in FIG. 1 or over a dancer roller control 19' as shown in FIG. 2.

Shaft steamer 1 consists of a simple housing open at the bottom, likewise mounted on stand 6. The endwise inlet wall 20 ends further down than wall 21 on the outlet side, so that only excess steam can escape from steamer 1. This steam is then captured and vented by means of hood 22 located outside wall 21. The required steam is supplied at the top through pipes 23 and then passes through perforated walls 24 into the processing chamber. Any condensate that is present flows down the sloping or vertical inside walls of the steamer into the gutters or troughs 25 that may be heated.

The steamer according to FIG. 2 resembles the steamer shown in FIG. 1 but the web guidance is provided for only a double input of the web. For this purpose, vacuum device 5 is directed upward in order to vacuum the horizontally aligned web from below. In the gore or space between downwardly traveling web 2 and deflecting roller 18 a spray tube 28 can also be provided to force other washing fluid at roller 18 through the textile material and vacuum it away at the same time. After passing around driven roller 27, the web then travels with the pile outward back into steamer 1, upward to steamer deflecting roller 26 and back down again to dancer roller control 19' as indicated. By means of the second steaming process, the nap or pile of the textile material can be evened out under the effects of heat in simple fashion.

The liquid for foaming under a steam atmopshere is sold for example by the Bayer company under the trademark "Levalin VKU-N." It consists basically of an alkylamide with an alkyl polyglycol sulfate. It is acid-resistant and is used essentially for polyamide tufting carpets. The same liquid is sold by the Ciba-Geigy company under the trade name "Irgapadol PN" and is prepared on the basis of a fatty acid amide and an alkyl polyglycol sulfate. The liquid is anionic and has a pH of 6.5–7.5.

What is claimed is:

1. Method for cleaning a continuously advancing web-form textile material treated with a washing-active liquid that contains one or more surfactants and a compound that exhibits a high adsorptivity for contaminants being washed out of the textile material and has a no affinity for fibers of the textile material, and subjected immediately thereafter to a steam treatment, wherein the textile material is saturated with a liquid containing compounds including foaming agents to produce foam in a steam atmosphere, the textile is transported into a steamer to generate a washing-active foam, the textile material is steamed in the steamer under saturated steam conditions, and then the textile material is vacuumed from a visible side of the web after passing through the steamer.

2. The method according to claim 1, wherein in textile material with a pile, the pile side is saturated with the liquid and the foam that is produced in the steamer is vacuumed off the pile side.

3. The method according to claim 1 or 2, wherein the textile material is steamed again after vacuuming.

4. The method according to claim 3, wherein the second steaming stage is performed without contacting the web of textile material on a pile side.

* * * * *